US008569940B2

(12) United States Patent
Keller et al.

(10) Patent No.: US 8,569,940 B2
(45) Date of Patent: Oct. 29, 2013

(54) SPARK PLUG HAVING GROUND ELECTRODE TIP ATTACHED TO FREE END SURFACE OF GROUND ELECTRODE

(71) Applicant: Federal-Mogul Ignition Company, Southfield, MI (US)

(72) Inventors: Richard L. Keller, Whitehouse, OH (US); Kevin J. Kowalski, Perrysburg, OH (US)

(73) Assignee: Federal-Mogul Ignition Company, Southfield, MI (US)

( * ) Notice: Subject to any disclaimer, the term of this patent is extended or adjusted under 35 U.S.C. 154(b) by 0 days.

(21) Appl. No.: 13/624,316

(22) Filed: Sep. 21, 2012

(65) Prior Publication Data

US 2013/0076224 A1 Mar. 28, 2013

Related U.S. Application Data

(60) Provisional application No. 61/538,236, filed on Sep. 23, 2011.

(51) Int. Cl.
*H01T 21/02* (2006.01)
*H01T 13/02* (2006.01)

(52) U.S. Cl.
USPC ..... 313/141; 313/142; 313/144; 445/7

(58) Field of Classification Search
CPC ..... H01T 13/20; H01T 21/02; H01T 13/46; H01T 21/06
USPC ..... 313/141, 142–145; 445/7; 123/141, 123/146.5 R; 140/71.5
See application file for complete search history.

(56) References Cited

U.S. PATENT DOCUMENTS

| | | | |
|---|---|---|---|
| 5,202,601 | A | 4/1993 | Takamura et al. |
| 5,465,022 | A | 11/1995 | Katoh et al. |
| 5,488,262 | A | 1/1996 | Takamura |
| 5,563,469 | A | 10/1996 | Takamura et al. |
| 5,574,329 | A | 11/1996 | Kagawa |
| 5,982,080 | A | 11/1999 | Shibata et al. |
| 6,307,307 | B1 | 10/2001 | Kanao |
| 6,337,533 | B1 | 1/2002 | Hanashi et al. |
| 6,470,845 | B2 | 10/2002 | Kanao |
| 6,621,198 | B2 | 9/2003 | Kanao et al. |
| 6,642,638 | B2 | 11/2003 | Ishiguro |
| 6,653,767 | B2 | 11/2003 | Morita et al. |
| 6,676,468 | B2 | 1/2004 | Ishiguro et al. |
| 6,707,237 | B2 | 3/2004 | Teramura et al. |
| 6,710,523 | B2 | 3/2004 | Segawa et al. |
| 6,720,716 | B2 | 4/2004 | Shibata et al. |
| 6,750,598 | B2 | 6/2004 | Hori |
| 6,853,116 | B2 | 2/2005 | Hori et al. |
| 6,923,699 | B2 | 8/2005 | Matsubara et al. |

(Continued)

OTHER PUBLICATIONS

Written Opinion & International Search Report for PCT/US12/056649, Mar. 18, 2013, 9 pages.

*Primary Examiner* — Tracie Y Green
(74) *Attorney, Agent, or Firm* — Reising Ethington P.C.

(57) ABSTRACT

A spark plug includes a metallic shell, an insulator, a center electrode body, a ground electrode body, and a ground electrode tip. In one embodiment, the ground electrode tip includes a non-precious metal piece and a precious metal piece attached to each other. The non-precious metal piece has a side surface attached to a free end surface of the ground electrode body.

20 Claims, 2 Drawing Sheets

(56) References Cited

U.S. PATENT DOCUMENTS

| | | | |
|---|---|---|---|
| 7,105,990 | B2 | 9/2006 | Shibata et al. |
| 7,145,287 | B2 | 12/2006 | Kato |
| 7,187,110 | B2 | 3/2007 | Suzuki |
| 7,352,121 | B2 | 4/2008 | Ito et al. |
| 7,382,085 | B2 | 6/2008 | Suzuki |
| 7,554,253 | B2 | 6/2009 | Koyama et al. |
| 7,652,413 | B2 | 1/2010 | Kawashima |
| 7,666,047 | B2 | 2/2010 | Suzuki et al. |
| 2006/0163992 | A1 | 7/2006 | Kanao et al. |
| 2007/0228916 | A1 | 10/2007 | Kunitomo et al. |
| 2009/0066211 | A1 | 3/2009 | Hartmann et al. |
| 2009/0127997 | A1 | 5/2009 | Kameda et al. |
| 2009/0134764 | A1 | 5/2009 | Kameda et al. |
| 2009/0140624 | A1 | 6/2009 | Kameda et al. |
| 2009/0160304 | A1 | 6/2009 | Kameda et al. |
| 2009/0160305 | A1 | 6/2009 | Kameda et al. |
| 2009/0302733 | A1 | 12/2009 | Nunome et al. |
| 2009/0309474 | A1 | 12/2009 | Nunome |
| 2009/0322198 | A1 | 12/2009 | Kameda et al. |
| 2010/0175654 | A1* | 7/2010 | Lykowski et al. ..... 123/169 EL |
| 2010/0264796 | A1 | 10/2010 | Musasa et al. |
| 2010/0264801 | A1 | 10/2010 | Tanaka et al. |
| 2010/0264802 | A1 | 10/2010 | Tanaka et al. |
| 2010/0264803 | A1 | 10/2010 | Nunome et al. |
| 2010/0264804 | A1 | 10/2010 | Kameda et al. |
| 2010/0320893 | A1 | 12/2010 | Kato |
| 2012/0074829 | A1* | 3/2012 | Lykowski ..... 313/141 |

* cited by examiner

SPARK PLUG HAVING GROUND ELECTRODE TIP ATTACHED TO FREE END SURFACE OF GROUND ELECTRODE

REFERENCE TO RELATED APPLICATIONS

This application claims the benefit of U.S. Provisional Ser. No. 61/538,236 filed on Sep. 23, 2011, the entire contents of which are incorporated herein.

TECHNICAL FIELD

This invention generally relates to spark plugs and other ignition devices for internal combustion engines and, in particular, to firing end configurations and assembly processes for spark plugs.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that is responsible for the power stroke of the engine. The high temperatures, high electrical voltages, rapid repetition of combustion reactions, and the presence of corrosive materials in the combustion gases can create a harsh environment in which the spark plug must function. This harsh environment can contribute to erosion and corrosion of the electrodes that can negatively affect the performance of the spark plug over time, potentially leading to a misfire or some other undesirable condition.

To reduce erosion and corrosion of the spark plug electrodes, various types of precious metals and their alloys—such as those made from platinum and iridium—have been used. These materials, however, can be costly. Thus, spark plug manufacturers sometimes attempt to minimize the amount of precious metals used with an electrode by using such materials only at a firing tip or spark portion of the electrodes where a spark jumps across a spark gap.

SUMMARY

According to one embodiment, a spark plug includes a metallic shell, an insulator, a center electrode body, a ground electrode body, and a ground electrode tip. The metallic shell has an axial bore, and the insulator has an axial bore. The insulator is disposed partially or more within the axial bore of the metallic shell. The center electrode body is disposed partially or more within the axial bore of the insulator. The ground electrode body is attached to the metallic shell and has a radially-facing free end surface. The ground electrode tip includes a non-precious metal piece and a precious metal piece. The non-precious metal piece and the precious metal piece are attached together. The non-precious metal piece has a side surface that is attached to the radially-facing free end surface of the ground electrode body.

According to another embodiment, a spark plug includes a metallic shell, an insulator, a center electrode body, a ground electrode body, and a ground electrode tip. The metallic shell has an axial bore, and the insulator has an axial bore. The insulator is disposed partially or more within the axial bore of the metallic shell. The center electrode body is disposed partially or more within the axial bore of the insulator. The ground electrode body is attached to the metallic shell and has an end portion tapering in size toward a radially-facing free end surface. The ground electrode tip has a side surface attached to the radially-facing free end surface of the ground electrode body. An axial extent of attachment between the side surface and the radially-facing free end surface constitutes a first axial extent $L_1$ of the ground electrode tip. And an axial extent of the ground electrode tip that is free of the attachment between the side surface and the radially-facing free end surface constitutes a second axial extent $L_2$ of the ground electrode tip. The first axial extent $L_1$ is less than the second axial extent $L_2$ in order to facilitate flame kernel growth in a combustion chamber.

According to yet another embodiment, a method of assembling a ground electrode body and a ground electrode tip includes several steps. In one step, a non-precious metal piece and a precious metal piece is provided. In another step, the non-precious metal piece and the precious metal piece are welded together to form the ground electrode tip. In yet another step, a side surface of the non-precious metal piece is welded to a free end surface of the ground electrode body.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

The firing end configurations and assembly processes described herein can be used in spark plugs and other ignition devices including industrial plugs, aviation igniters, or any other device that is used to ignite an air/fuel mixture in an engine. This includes spark plugs used in automotive internal combustion engines and particularly engines equipped to provide gasoline direct injection (GDI), engines operating under lean burning strategies, engines operating under fuel efficient strategies, engines operating under reduced emission strategies, or a combination thereof. The firing end configurations can provide high ignitability as compared to some other known configurations, and can provide high durability. Furthermore, in some embodiments the firing end configurations described herein use precious metal material efficiently and economically, and in some embodiments the firing end configurations facilitate accurate alignment and spacing of a spark gap G during the assembly process. As used herein, the terms axial, radial, and circumferential describe directions with respect to the generally cylindrical shape of the spark plug of FIG. 1 and with respect to a center axis A of the spark plug, unless otherwise specified.

Figure 1:
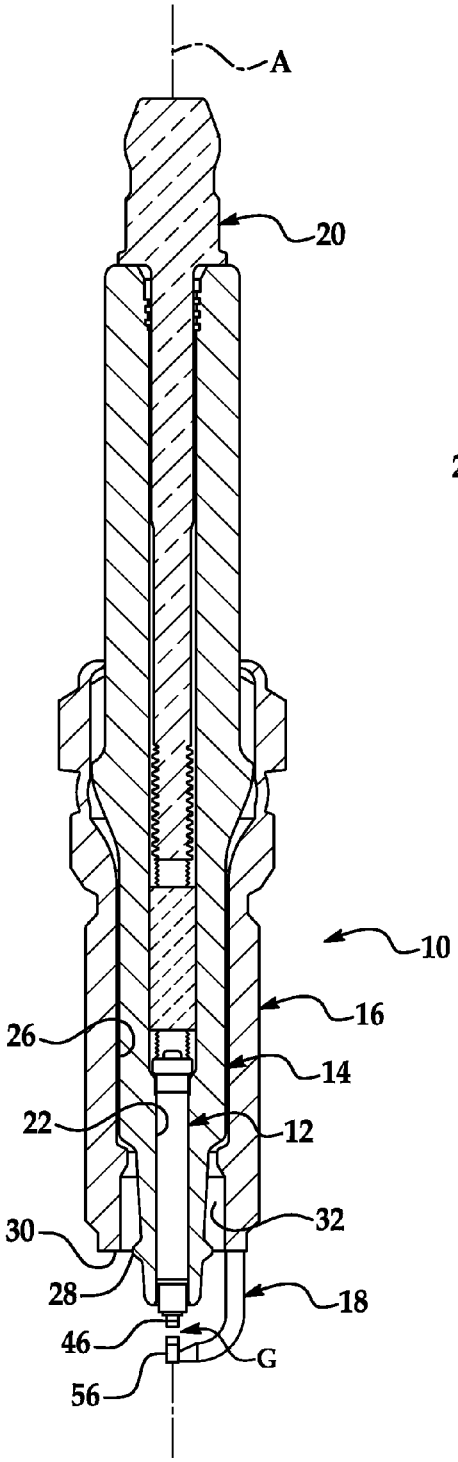
FIG. 1 is a cross-sectional view of an embodiment of a spark plug.
Figure 2:
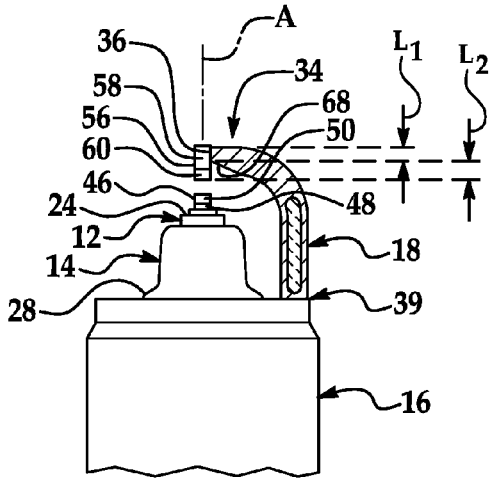
FIG. 2 is an enlarged view of a firing end of the spark plug of FIG. 1.

Referring to FIG. 1, a spark plug 10 includes a center electrode (CE) body 12, an insulator 14, a metallic shell 16, and a ground electrode (GE) body 18. Other components can include a terminal stud 20, an internal resistor, various gaskets, and internal seals, all of which will be known to those skilled in the art. The center electrode base or body 12 is disposed within an axial bore 22 of the insulator 14, and has an end portion exposed outside of the insulator at a firing end of the spark plug 10. In one example, the center electrode body 12 is made of a nickel (Ni) alloy material—such as an alloy composed of one or more of Ni, chromium (Cr), iron (Fe), manganese (Mn), silicon (Si), or another element—serving as an external portion of the body, and is made of a copper (Cu) material serving as an internal core of the body; other examples are possible including a body of a single material. Referring now to FIG. 2, the center electrode body 12 has an axially-facing free end surface 24. In this embodiment, the axially-facing free end surface 24 is generally planar and without any surface indentations.

The insulator 14 is disposed within an axial bore 26 of the metallic shell 16, and has an end nose portion exposed outside of the shell at the firing end of the spark plug 10. The insulator 14 is made of a material, such as a ceramic material, that electrically insulates the center electrode body 12 from the metallic shell 16. At its end nose portion, the insulator 14 can, though need not, have a rib 28 extending circumferentially therearound and protruding radially outwardly therefrom. If provided, the rib 28 is located at an axial position on the insulator 14 in general alignment with an open end 30 of the metallic shell 16. The rib 28 then provides a physical barrier at an entrance to a pocket clearance 32 formed by a confrontation between an outer surface of the insulator 14 and an inner surface of the metallic shell 16. The rib 28 limits or altogether prevents carbon fouling and other build-up from entering the pocket clearance 32, and therefore can improve general ignitability and particularly cold start performance of the spark plug 10. The metallic shell 16 provides an outer structure of the spark plug 10, and has threads for installation to the associated engine.

Figure 3:
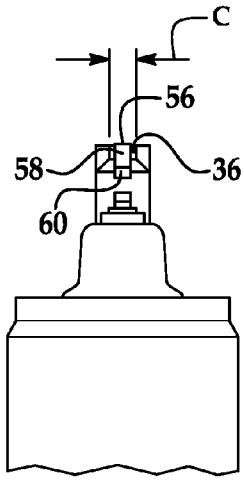
FIG. 3 is another enlarged view of the firing end of FIG. 2.
Figure 8:
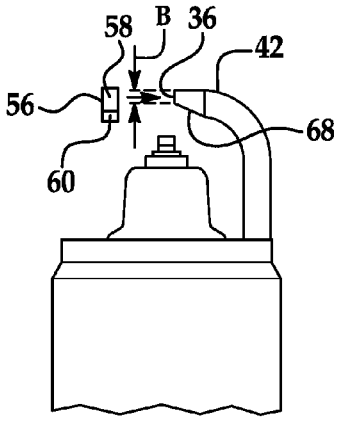
FIG. 8 shows yet another step of the ground electrode assembly process of FIG. 6.

Referring to FIGS. 1 and 2, the ground electrode base or body 18 can be attached via an initial resistance weld and a subsequent laser weld to a free end of the metallic shell 16 and, as a finished product, has a generally and somewhat conventional L-shape. At an end portion 34 nearest the spark gap G of the spark plug 10, the ground electrode body 18 is generally located axially away from the center electrode body 12 and a center electrode tip (if one is provided). In one example, the ground electrode body 18 is made of a Ni alloy material—such as an alloy commonly called Inconel® 601 or an alloy composed of one or more of Ni, Cr, Fe, Mn, Si, or another element—serving as an external portion of the body, and is made of a Cu material serving as an internal core of the body; other examples are possible including a body of a single material. The ground electrode body 18 has a radially-facing free end surface 36 (shown best in FIG. 3). The radially-facing free end surface 36 is generally planar and without any surface indentations in the figures, but in other embodiments a groove or notch 37 (shown in phantom in FIG. 6) could be formed in the radially-facing free end surface 36 to facilitate placement and alignment of a ground electrode tip therein. In some instances, and depending on the cross-sectional profile of the associated tip, the notch 37 can have a V-shaped cross-section as shown, or can have a rectangular cross-section, semi-circular cross-section, or a U-shaped cross-section. Also, the radially-facing free end surface 36 is generally parallel with the center axis A of the spark plug 10, but need not be and instead could be slanted at a non-parallel angle and relationship relative to the center axis A. In one embodiment the radially-facing free end surface 36 is located on a radial side of a center electrode tip closer to an attachment point 39 between the ground electrode body 18 and the metallic shell 16 (this geometric relationship is best shown in FIG. 2). And in one embodiment, the radially-facing free end surface 36 is located at a radial position that falls within an imaginary axial projection of a circumference of a center electrode tip sparking surface; this depends in part upon the diameter of the center electrode tip and need not be the case in other embodiments. Referring to FIGS. 3 and 8, the radially-facing free end surface 36 has an axial thickness dimension B and a radial width dimension C. In one example, the axial thickness dimension B can have a value that ranges between approximately 0.5 mm and 0.7 mm or that is approximately 0.6 mm, and the radial width dimension C can have a value that ranges between approximately 1.0 mm and 1.4 mm or that is approximately 1.2 mm; other values are possible in other examples.

Referring now to FIGS. 2, 3, 6, 7, and 8, from end-to-end the ground electrode body 18 has a longitudinal length D that is smaller in value than other known ground electrode bodies used in other known firing end configurations where the bodies extend farther in the radial direction across a center electrode tip. In general, a smaller longitudinal length D provides a lower overall operating temperature of a ground electrode body, and consequently can reduce or eliminate the need for a higher conductivity core such as a Cu core. Lower overall operating temperatures can also reduce electrode oxidation. The ground electrode body 18 has a first side surface 38, a second side surface 40, a top surface 42, and a bottom surface 44. A majority of the ground electrode body 18 has a similarly dimensioned rectangular cross-sectional profile. At the end portion 34, however, the ground electrode body 18 can be narrowed in the axial dimension, in the radial dimension, or in both dimensions. For example, the ground electrode body 18 can be tapered, rounded, or otherwise modified in axial thickness beginning on the end portion 34 and ending at the radially-facing free end surface 36. Further, the ground electrode body 18 can be tapered, rounded, or otherwise modified in radial width beginning on the end portion 34 and ending at the radially-facing free end surface 36. In one example, and referring now to FIGS. 6 and 7, the first and second side surfaces 38, 40 can be cut at an angle $\alpha$ that ranges approximately between 63° and 69° or that is approximately 66°, and the bottom surface 44 can likewise be cut at an angle $\beta$ that ranges approximately between 63° and 69° or that is approximately 66°; other angles are possible in other examples. In these tapered embodiments, the dimensions B and C of the radially-facing free end surface 36 are less than the respective axial thickness and radial width of the ground electrode body 18 taken elsewhere away from the radially-facing free end surface. In an embodiment not shown in the drawings, the radially-facing free end surface 36 can be rounded off in a semi-circular shape instead of a v-trim.

Figure 4:
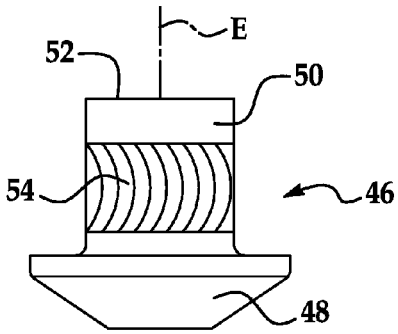
FIG. 4 is an enlarged side view of a center electrode tip before attachment to a center electrode body.

In the embodiment shown in the figures, the spark plug 10 includes an optional center electrode tip 46 located on the axially-facing free end surface 24 of the center electrode body 12; in other embodiments, a center electrode tip is not provided and a spark is ignited with the center electrode body itself. Referring to FIGS. 2 and 4, the center electrode tip 46 has a two-piece and generally rivet-like construction, and includes a first piece 48 and a second piece 50; in other embodiments, the center electrode tip can have a one-piece and a one-material construction. The first piece 48 makes direct physical contact with the center electrode body 12, and can be attached to the center electrode body via welding such as resistance welding or via another metal attachment technique; the exact attachment technique can depend on the materials being attached. The second piece 50 provides a spark during use of the spark plug 10, and has an axially-facing free end surface 52, or sparking surface, that exchanges sparks during a spark-firing event. The first and second pieces 48, 50 are attached together via welding, such as laser welding, to produce a weldment portion 54 which can be a mix of materials from both the first and second pieces; again, the exact attachment technique can depend on the materials being attached. The center electrode tip 46 has a longitudinal or center axis E that, in assembly, is in general alignment with the center axis A of the spark plug 10.

In one embodiment, the first piece 48 is made of a Ni-alloy material such as one containing a relatively increased amount of chromium (Cr) like Ni20Cr; other materials are possible. And in one embodiment, the second piece 50 is made of a precious metal material such as an iridium (Ir) alloy like one containing approximately 2% rhodium (Rh), 0.3% tungsten (W), 0.02% zirconium (Zr), and the balance being Ir (shown in mass percentages). Other materials are possible for the second piece 50 including pure Ir, and alloys and non-alloys of platinum (Pt), ruthenium (Ru), rhodium (Rh), palladium (Pd), and rhenium (Re), to name a few. In one example in which the first piece 48 is a Ni-alloy piece and the second piece 50 is an Ir-alloy piece, wires of the Ni alloy and the Ir alloy having a diameter of approximately 0.7 mm are brought together end-to-end and laser welded to produce the welding portion 54; the wires are cut to a desired length; the Ni-alloy piece is metalworked to form a rivet-like structure for the center electrode tip 46 with a diametrically-enlarged head portion and a diametrically-reduced stem portion; and the Ni-alloy piece is resistance welded to the axially-facing free end surface 24 of the center electrode body 12. Furthermore, for the example in which the first piece 48 is a Ni-alloy piece and the second piece 50 is an Ir-alloy piece, the two-piece construction can facilitate attachment of the Ir-alloy piece by providing a stronger joint between the Ni-alloy piece and the center electrode body 12, as compared to a joint between the Ir-alloy piece and the center electrode body; this, of course, will depend on the materials used for the components, and can be exhibited by other materials apart from the example. Additionally, the two-piece construction minimizes the amount of precious metal material used by providing the precious metal only at the sparking portion of the tip.

Figure 5:
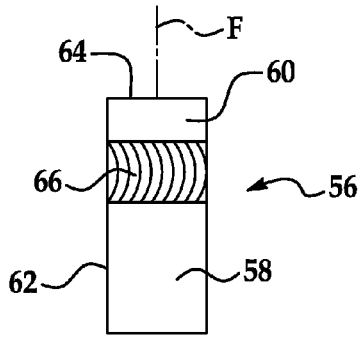
FIG. 5 is an enlarged side view of a ground electrode tip before attachment to a ground electrode body.

Referring to FIGS. 2 and 5, the spark plug 10 further includes a ground electrode tip 56 located at the radially-facing free end surface 36 of the ground electrode body 18. The ground electrode tip 56 has a two-piece and generally cylindrical construction, and includes a first piece 58 and a second piece 60. In embodiments not shown in the figures, the ground electrode tip can have a one-piece and a one material construction. In the embodiment of the figures, the first piece 58 makes direct physical contact with the ground electrode body 18, while the second piece 60 does not make direct physical contact with the ground electrode body; in other embodiments not shown, the second piece 60 could indeed make direct physical contact with the ground electrode body. In particular in the figures, the ground electrode tip 56 has a side surface 62 that makes surface-to-surface contact with the radially-facing free end surface 36 at the first piece 58, while the side surface at the second piece 60 is free of contact with the radially-facing free end surface. The first piece 58 can be attached to the ground electrode body 18 via welding such as resistance welding, laser welding, a combined initial resistance tack weld and subsequent laser weld, or via another metal attachment technique; the exact attachment technique can depend on the materials being attached together.

The second piece 60 provides a spark during use of the spark plug 10, and has an axially-facing free end surface 64, or sparking surface, that exchanges sparks during a spark-firing event. In the embodiment of the figures, the axially-facing free end surfaces 64, 52 of the ground and center electrode tips 46, 56 confront or oppose each other, are generally parallel with each other, and define the spark gap G therebetween. The spark gap G can range between approximately 0.65 mm and 1.0 mm, or can have another value. The first and second pieces 58, 60 are attached together via welding, such as laser welding, to produce a weldment portion 66 which can be a mix of materials from both the first and second pieces; again, the exact attachment technique can depend on the materials being attached. In this embodiment, the weldment portion 66 does not make direct physical contact with the ground electrode body 18, only the unwelded first piece 58 does; but as before, in other embodiments not shown, the weldment portion could indeed make direct physical contact with the ground electrode body, particularly the radially-facing free end surface 36.

The ground electrode tip 56 has a longitudinal or center axis F that, in the embodiment of FIG. 2, is aligned and coincident with the center axis A of the spark plug 10 and with the longitudinal axis E of the center electrode tip 46; in other embodiments, the center axis F can be slightly radially offset from the longitudinal axis E and such that axes F and E are offset but still parallel to each other. In one example bending step, the ground electrode body 18 is bent toward the center electrode tip 46 and the radial edges of the GE and CE tips farthest away from the shell/GE attachment point 39 are aligned with each other. In one example, because of slight differences in diameter between the sparking pieces 50, 60 of the CE and GE tips, the longitudinal axes F, E are slightly offset but still parallel with respect to each other.

Referring to FIGS. 3 and 5, the first piece 58 has a greater axial thickness or longitudinal length dimension than that of the second piece 60. The first piece 58 also has a greater length dimension as compared to the axial thickness dimension B of the radially-facing free end surface 36. In the embodiment of the figures in which only the first piece 58 makes direct physical contact with the ground electrode body 18, the greater length dimension of the first piece compared to dimension B helps ensure the absence of physical contact between the second piece 60 and the ground electrode body. And the first piece 58 has a radial width dimension or diameter that is less than the radial width dimension C of the radially-facing free end surface 36; this can help ensure suitable placement and attachment between the first piece and the radially-facing free end surface.

In one embodiment, the first piece 58 is made of a non-precious metal material such as a Ni-alloy material like one containing a relatively increased amount of chromium (Cr) like Ni20Cr; other materials are possible. And in one embodiment, the second piece 60 is made of a precious metal material such as an iridium (Ir) alloy like one containing approximately 2% rhodium (Rh), 0.3% tungsten (W), 0.02% zirconium (Zr), and the balance being Ir (shown in mass percentages). Other materials are possible for the second piece 60 including pure Ir, and alloys and non-alloys of platinum (Pt), ruthenium (Ru), rhodium (Rh), palladium (Pd), and rhenium (Re), to name a few. In one example in which the first piece 58 is a Ni-alloy piece and the second piece 60 is an Ir-alloy piece, wires of the Ni alloy and the Ir alloy having a diameter of approximately 0.7 mm are brought together end-to-end and laser welded to produce the weldment portion 66; the wires are cut to a desired length; and then the Ni-alloy piece is resistance welded, laser welded, or both, to the radially-facing free end surface 36 of the ground electrode body 18. In another example, the center electrode tip 46 and the ground electrode tip 56 need not have the same diameters and instead can have diameters of different values; for instance, the second piece 50 of the center electrode tip can have a diameter of approximately 0.74 mm and the second piece 60 of the ground electrode tip can have a diameter of approximately 0.70 mm. Furthermore, for the example in which the first piece 58 is a Ni-alloy piece and the second piece 60 is an Ir-alloy piece, the two-piece construction can facilitate attachment of the Ir-alloy piece by providing a stronger joint between the Ni-alloy piece and the ground electrode body 18, as compared to a joint between the Ir-alloy piece and the ground electrode body; this, of course, will depend on the materials used for the components, and can be exhibited by other materials apart from the example. Additionally, the two-piece construction minimizes the amount of precious metal material used by providing the precious metal only at the sparking portion of the tip.

One or more of the above described geometric dimensions and relationships of the firing end configuration of the spark plug 10 contributes to high ignitability and high durability performance during use. For example, the geometric dimensions and relationships involving the ground electrode body 18, the radially-facing free end surface 36, the center electrode tip 46, and the ground electrode tip 56 can contribute to high ignitability and high durability performance during use.

Figure 9:
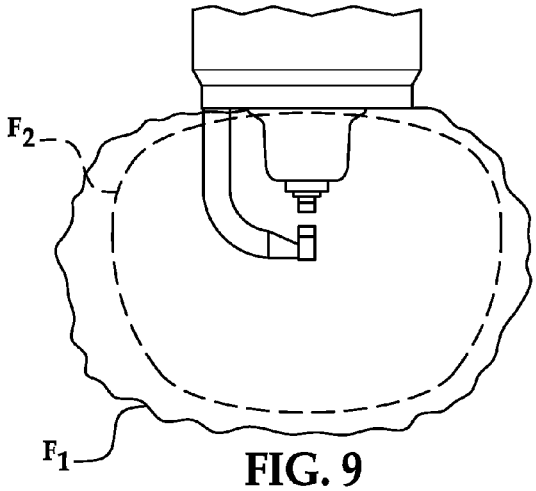
FIG. 9 shows a simulated model of flame kernel development generated amid a spark-firing event by the firing end of FIGS. 1-3.

In a specific example, and referring back to FIG. 2, an axial thickness tapered section 68 on the end portion 34 can contribute to ignitability and to adherence durability between the ground electrode tip 56 and the ground electrode body 18. The tapered section 68 enhances ignitability by providing an absence of material (compared to a non-tapered end portion 34) adjacent flame kernel initiation during a spark-firing event, thereby facilitating flame kernel growth and emanation without absorption and diminishment from the material now absent at the tapered section. This enhanced ignitability is demonstrated in the schematic illustration of a simulated model of flame kernel development shown in FIG. 9. The model was processed via simulation software provided by ANSYS, Inc. headquartered in Canonsburg, Pa., U.S.A. The figure shows an illustration of a snapshot of flame kernel development taken amid a spark-firing event at the time of 0.029 seconds after initiation of the spark-firing event. The outer solid line $F_1$ represents the flame kernel development of a firing end configuration like that of FIG. 2, also shown in FIG. 9, in which the end portion 34 has the axial thickness tapered section 68. And the inner broken line $F_2$ represents the flame kernel development of a firing end configuration similar to that of FIG. 2 but without an axial thickness tapered section, and instead with a non-axial-tapered end portion. The larger flame kernel $F_1$ provides better ignitability and combustibility during use of the spark plug. It should be appreciated by skilled artisans that not all simulations will yield the exact flame kernel representations schematically illustrated in FIG. 9. FIG. 9 is simply meant to demonstrate some of the basic characteristics of flame kernel growth, as it relates to the exemplary spark plug, and is not meant to be an exact representation of the results of the model.

Moreover, ignitability is enhanced by greater exposure and availability of the ground electrode tip 56 during a spark-firing event. For instance, having an increased axial or longitudinal extent of the ground electrode tip 56 free of attachment to the radially-facing free end surface 36 can facilitate flame kernel growth. Still referring in particular to FIG. 2, a first axial extent $L_1$ of the junction or interface of attachment between the side surface 62 and the radially-facing free end surface 36 is less than a second axial extent $L_2$ of the ground electrode tip free of attachment between the side surface and the radially-facing free end surface. This relationship enhances ignitability because more of an unattached longitudinal section of the ground electrode tip 56 is exposed and available for firing.

Further, the tapered section 68 enhances adherence durability between the ground electrode tip 56 and the ground electrode body 18 by reducing thermal mass (compared to a non-tapered end portion 34) at the attachment point between the side surface 62 and the radially-facing free end surface 36, thereby shortening the duration of increased temperatures at the attachment point. Increased and prolonged temperatures could adversely affect adherence at the attachment point, including warping and even unattachment of the ground electrode tip 56.

Furthermore, the tapered section 68 provides greater flexibility with installation and positioning of the firing end within an engine combustion chamber. More of an axial or longitudinal extent of the ground electrode tip 56, including its second piece 60 of precious metal material, is exposed and available for firing by way of the tapered section 68. In certain designs, this permits a shortened overall axial height of the L-shaped ground electrode body 18 measured in the axial direction from the attachment point 39 to the axially-facing top surface 42 opposite the attachment point. The attachment to the radially-facing free end surface 36 also permits the shortened overall axial height. A previously-known fine wire design in which a GE tip is attached to a bottom surface of its GE body, in contrast, requires a greater overall axial height in order to effectuate the same axial exposure and availability of its GE tip. With a shortened overall axial height, the spark-firing location at the firing end can be more readily installed and positioned within the engine combustion chamber because there is more space for movement relative to the chamber. In one example, the L-shaped ground electrode body 18 can have an overall axial height that ranges between approximately 7.0 mm and 7.6 mm or that is approximately 7.3 mm; other axial height values are possible in other examples.

Figure 6:
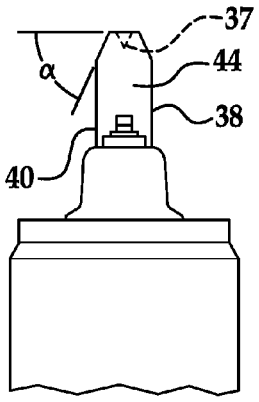
FIG. 6 shows one step of an embodiment of a ground electrode assembly process.
Figure 7:
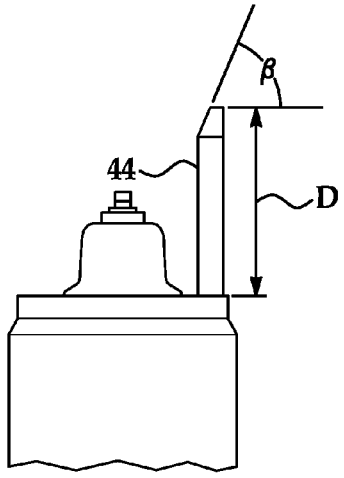
FIG. 7 shows another step of the ground electrode assembly process of FIG. 6.

FIGS. 6-8 show several steps involved in one embodiment of an assembly process of the ground electrode body 18 and the ground electrode tip 56. In the step depicted in FIG. 6, the end portion 34 of the ground electrode body 18 is trimmed, cut, or otherwise metalworked to produce the narrowed radial width C; and in the step depicted in FIG. 7, the end portion of the ground electrode body is trimmed, cut, or otherwise metalworked to produce the narrowed axial thickness B; of course, the order of these steps could be reversed. Then, in the step depicted in FIG. 8, the ground electrode tip 56 is attached to the ground electrode body 18. In a preferred embodiment the ground electrode tip 56 is attached to the ground electrode body 18 after the ground electrode body is bent to a final position toward the center electrode body 12 (L-shape). The ability to attach the ground electrode tip 56 after the ground electrode body 18 is finally bent is facilitated by the location of the ground electrode tip at the radially-facing free end surface 36 of the ground electrode body. In another embodiment, the ground electrode tip 56 can be attached to the ground electrode body 18 before the ground electrode body is bent to a final L-shape position, in which case the ground electrode tip would be bent to the L-shape as the ground electrode body is bent, and would be aligned and spaced with the center electrode tip 46 to produce the spark gap G.

The spark plug 10 in the embodiments as described and shown can facilitate accurate alignment and spacing of the spark gap G, which in some cases can be difficult due to accumulated tolerances among the components in the assembly process. For example, the accumulated tolerances of one or more of i) the insulator placement step inside of the shell, ii) the CE tip weld location on the CE body, iii) the trimming of the overall length of the GE body, iv) the GE body weld location on the shell, and v) the GE tip weld location on the GE body, can all affect the alignment and spacing of the spark gap G. In the assembly process of the ground electrode body 18 and the ground electrode tip 56 described in which the ground electrode tip is attached after final bending of the ground electrode body to its L-shape, the ground electrode tip is attached as one of the latter steps of the assembly process. In this way, one or more of the tolerances described above has little or no affect on the alignment and spacing of the spark gap G because their associated steps are performed before the ground electrode tip 56 is attached to the ground electrode body 18. The spark gap G can therefore be precisely aligned and spaced, and positively set without bending the ground electrode body 18 to do so. Bending the ground electrode body 18 to set the spark gap G can require over-bending due to spring-back of the electrode materials which, although suitable in some cases, can be troublesome and can cause inaccuracies. Also, such bending can induce stresses in the electrode materials that can be relieved somewhat during high temperature operation in an engine, thereby causing the spark gap G to increase or decrease in size during use.

Furthermore, in some embodiments it may be useful to construct the spark plug 10 so that the spark gap G can be repeatedly located and oriented for installation in an engine. For example, when used in engines with GDI, the location and orientation of the spark gap G with respect to the associated fuel injector may be desired in some cases for suitable fuel ignition. In order to locate and orient the spark gap G when installed for use, the ground electrode body 18 can be attached to the metallic shell 16 at a position corresponding to some other feature of the spark plug 10 that is used to control its rotational position when installed. For example, the ground electrode body 18 can be attached to the metallic shell 16 at a pre-determined position with respect to a beginning or ending point of threads formed in the shell, or with respect to a shoulder or some other positive structural stop that rotationally positions the spark plug 10 when installed. As another example, the ground electrode body 18 can be attached to the metallic shell 16 at a pre-determined position with respect to a line, mark, or other visual indicia that an installer can use to align with corresponding visual indicia on the engine, or that can be read by a machine vision system. These are of course only examples, and other methods may be employed.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A spark plug, comprising:

a metallic shell having an axial bore;

an insulator having an axial bore and being disposed at least partially within said axial bore of said metallic shell;

a center electrode body disposed at least partially within said axial bore of said insulator;

a ground electrode body attached to said metallic shell and having a radially-facing free end surface; and a ground electrode tip including a non-precious metal piece and a precious metal piece attached together, said non-precious metal piece having a side surface attached to said radially-facing free end surface of said ground electrode body.

2. A spark plug as defined in claim 1, wherein said insulator has a rib extending circumferentially therearound and protruding radially outwardly therefrom, and said rib is located axially on said insulator in general alignment with an open end of said metallic shell.

3. A spark plug as defined in claim 1, wherein said ground electrode body includes an end portion that tapers in axial thickness toward said radially-facing free end surface.

4. A spark plug as defined in claim 3, wherein said end portion of said ground electrode body also tapers in radial width toward said radially-facing free end surface.

5. A spark plug as defined in claim 3, wherein an axial thickness dimension of said radially-facing free end surface is less than a longitudinal length of said non-precious metal piece.

6. A spark plug as defined in claim 1, wherein said radially-facing free end surface is generally planar and free of notches.

7. A spark plug as defined in claim 1, wherein said radially-facing free end surface has a notch located therein to facilitate placement of said ground electrode tip.

8. A spark plug as defined in claim 1, wherein said ground electrode tip has a longitudinal axis that is generally parallel with a center axis of the spark plug.

9. A spark plug as defined in claim 1, further comprising a center electrode tip attached to said center electrode body and having a longitudinal axis generally parallel with a longitudinal axis of said ground electrode tip.

10. A spark plug as defined in claim 1, wherein said non-precious metal piece is a Ni-alloy piece and said precious metal piece is an Ir-alloy piece.

11. A spark plug as defined in claim 9, wherein said precious metal piece of said ground electrode tip has an axially-facing free end surface, and said center electrode tip has an axially-facing free end surface, and said axially-facing free end surfaces of said precious metal piece and of said center electrode tip directly confront each other and generate a spark therebetween during use of the spark plug.

12. A spark plug as defined in claim 1, wherein said precious metal piece does not directly contact said radially-facing free end surface of said ground electrode body.

13. A spark plug as defined in claim 1, wherein a weldment portion is located at the attachment between said non-precious metal piece and said precious metal piece, and said weldment portion does not directly contact said radially-facing free end surface of said ground electrode body.

14. A spark plug, comprising:

a metallic shell having an axial bore;

an insulator having an axial bore and being disposed at least partially within said axial bore of said metallic shell;

a center electrode body disposed at least partially within said axial bore of said insulator;

a ground electrode body attached to said metallic shell and having an end portion tapering in size toward a radially-facing free end surface; and a ground electrode tip having a side surface attached to said radially-facing free end surface of said ground electrode body, wherein an axial extent of attachment between said side surface and said radially-facing free end surface constitutes a first axial extent $L_1$ of said ground electrode tip, an axial extent of said ground electrode tip free of the attachment between said side surface and said radially-facing free end surface constitutes a second axial extent $L_2$ of said ground electrode tip, and said first axial extent $L_1$ is less than said second axial extent $L_2$ in order to facilitate flame kernel growth in a combustion chamber.

15. A spark plug as defined in claim 14, wherein said end portion of said ground electrode body tapers in axial thickness toward said radially-facing free end surface.

16. A spark plug as defined in claim 15, wherein said ground electrode tip includes a Ni-alloy piece and a precious metal piece, said Ni-alloy piece and said precious metal piece are attached together, said Ni-alloy piece is attached to said radially-facing free end surface of said ground electrode body and said precious metal piece is not attached to said radially-facing free end surface.

17. A spark plug as defined in claim 16, wherein an axial thickness dimension of said radially-facing free end surface is less than a longitudinal length of said Ni-alloy piece.

18. A method of assembling a ground electrode body and a ground electrode tip, the method comprising the steps of:

providing a non-precious metal piece and a precious metal piece;

welding said non-precious metal piece and said precious metal piece together to form said ground electrode tip; and welding a side surface of said non-precious metal piece to a free end surface of said ground electrode body.

19. A method as defined in claim 18, further comprising the step of trimming said ground electrode body wherein an end portion of said ground electrode body tapers in axial thickness toward said radially-facing free end surface.

20. A method as defined in claim 18, wherein the step of welding a side surface of said non-precious metal piece to a free end surface of said ground electrode body is performed after said ground electrode body is attached to a metallic shell and is bent to its final position.

* * * * *